US006467475B2

(12) United States Patent
Leutner et al.

(10) Patent No.: US 6,467,475 B2
(45) Date of Patent: Oct. 22, 2002

(54) STOVE FOR COOKING FOOD WITH A VIEWING WINDOW, AND A VIEWING WINDOW FOR HOUSEHOLD APPLIANCES, SUCH AS COOKING STOVES OR OVENS

(75) Inventors: Kurt Leutner, Mainz; Oliver Gros, Rheinböllen, both of (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/898,918

(22) Filed: Jul. 3, 2001

(65) Prior Publication Data

US 2002/0046749 A1 Apr. 25, 2002

(30) Foreign Application Priority Data

Jul. 5, 2000 (DE) ..... 100 32 733

(51) Int. Cl.[7] ..... F23M 7/00

(52) U.S. Cl. ..... 126/190; 126/200; 126/19 R; 219/756; 160/120; 160/310

(58) Field of Search ..... 126/190, 192, 126/198, 200, 19 R, 544, 552; 160/120, 133, 188, 189, 192, 238, 309–315; 129/756; 236/99 D; 49/171; 62/248, 246

(56) References Cited

U.S. PATENT DOCUMENTS 3,433,213 A * 3/1969 Huff et al. ..... 126/200
3,565,054 A * 2/1971 Smith ..... 126/200
4,813,198 A * 3/1989 Johnston et al. ..... 160/310
6,168,291 B1 * 1/2001 Rockey et al. ..... 160/315

FOREIGN PATENT DOCUMENTS

| | | | |
|---|---|---|---|
| DE | 1579605 | 8/1970 | |
| DE | 2153275 | 6/1972 | |
| DE | 9108355 | 10/1991 | |
| DE | 4122847 | 1/1993 | |
| EP | 0653592 | 5/1995 | |
| JP | 0217022 | * 9/1987 | ..... 126/200 |
| JP | 0917061 | 6/1997 | |

* cited by examiner

*Primary Examiner*—James C. Yeung
(74) *Attorney, Agent, or Firm*—Nils H. Ljungman & Associates

(57) ABSTRACT

The invention relates to a stove for cooking food with a viewing window, and a viewing window for household appliances, such as cooking stoves or ovens, which window can be mounted in a wall of the housing of the stove for cooking food or the household appliance such as a cooking stove or oven, and which window is comprised of at least two transparent panes arranged at a distance from one another, whereby between the two transparent panes there is contemplated a screen, or blind, which covers, or closes, the viewing area, and which screen is adjustable from the exterior of the appliance.

20 Claims, 9 Drawing Sheets

STOVE FOR COOKING FOOD WITH A VIEWING WINDOW, AND A VIEWING WINDOW FOR HOUSEHOLD APPLIANCES, SUCH AS COOKING STOVES OR OVENS

BACKGROUND INFORMATION

1. Field of the Invention

The invention relates to a stove for cooking food with a viewing window, and a viewing window for household appliances, such as cooking stoves or ovens, which window can be mounted in a wall of the housing of the stove for cooking food or the household appliance such as a cooking stove or oven, and which window is comprised of at least two transparent panes arranged at a distance from one another, whereby between the two transparent panes there is contemplated a screen, or blind, which covers, or closes, the viewing area, and which screen is adjustable from the exterior of the appliance.

2. Background Information

There are several types of household appliances to which the invention has applicability, in particular such appliances as baking appliances and cooking appliances, refrigerators, freezer chests or freezers, microwave appliances, and space heaters. With such household appliances, the interior thereof is viewable by way of the viewing window. There arises, however, the desire at times that viewing of the interior of the household appliance should be temporarily precluded or, respectively, that viewing be permitted only when required under certain circumstances. Up till now, in practical application for the solution of this problem, there was made the attempt to make improvisation with an outer cover that is applied in individual manner, but such a solution can only be considered a temporary solution since this cover is difficult to instal and since it negatively impacts the outer appearance of the household appliance at hand.

The Federal Republic of Germany Utility Model No. DE 91 08 355 U1 makes known a viewing window for household appliances, which window can be mounted in the wall of the housing of the household appliance, and which window is comprised of at least two transparent panes disposed at a distance from one another to form a space between the panes, in which space a cover is contemplated which covers, or closes, the viewing area, and which cover can be adjusted from the exterior of the appliance.

In the known embodiment, the cover that can be adjusted from the exterior comprises a plurality of lamellas, or elements, which extend vertically, and which are disposed, or journalled, by way of pivot pins disposed in receiving holes, so as to be swingable about a vertical axis. As can be clearly seen in the drawing figures of the mentioned reference, the known embodiment construction is relatively cumbersome. Furthermore, even if the lamellas are in the fully open position, that is, when they are disposed perpendicularly to the viewing pane, a fully unobstructed viewing into the interior of the household appliance is only provided in a viewing direction which is fully perpendicular to the door. When viewing under an angle, the lamellae surfaces reduce the viewing field, or area.

OBJECT OF THE INVENTION

It is the object of the invention, commencing with the viewing window characterized in the introduction, to configure this to be of a simple design and to provide a fully accessible viewing area upon opening of the blind or cover.

SUMMARY OF THE INVENTION

The invention teaches that this object can be accomplished with a stove for cooking food, said stove comprising a stove body being configured with a support comprising feet. The stove body being configured with an interior confined by walls comprising side walls, a front wall, and a rear wall. The stove has an oven, a heating arrangement configured and disposed to provide heating to cook food in said oven and control apparatus to control the heating arrangement. There is also provided a door in the front wall, which door comprises a window arrangement configured with a viewing area to view food being cooked in the interior of the oven. The window arrangement comprises a first pane and a second pane disposed at a distance from the first pane. The first pane becomes the inner pane upon installation in the stove and the second pane becomes an outer pane upon installation in the stove. An arrangement is provided to maintain the first and second panes in spaced relationship. A roller blind arrangement is disposed between the first and second panes, which roller blind arrangement comprises a portion to obscure viewing into the interior of the stove, and a portion to permit viewing into the oven. There is also provided an arrangement to move the portion to permit viewing into the stove, and to move the portion to obscure viewing into the interior of the oven, with the roller blind arrangement being configured to obscure the viewing area of the window to minimize heat radiation from the heating arrangement reaching the ambient surrounding of the stove and to minimize radiation and to provide a uniform heat reflection impinging upon the closed roller blind arrangement to thus supply a substantial constant internal configuration for reflecting heat back into the stove interior.

The invention further teaches that this object can be accomplished, for a viewing window for household appliances, which viewing window can be mounted, or placed, in a wall of the housing of the household appliance, and which window comprises at least two transparent panes arranged at a distance from one another, whereby between the two transparent panes there is contemplated a screen, or cover, or blind, which covers, or closes, the viewing area, and which screen is adjustable from the exterior of the appliance, in accordance with the invention thereby that the cover is configured as roller blind, or curtain, which has two rollers, of which one is arranged adjacent to the viewing window at the top and the other is arranged adjacent to the viewing window at the bottom, and one of the rollers comprises a torsion spring, as is typical for a self-winding curtain, and the other roller can be driven; and that one end of the roller blind is secured to the roller comprising the torsion spring, and the other end of the roller blind is connected, by way of pulling elements, to the roller that can be driven.

Such a configuration of the cover, or screen, of the viewing window is relatively simple, such that it can be produced with low cost-benefit ratio and is easily assembled and installed.

Furthermore, the viewing area of the viewing window can be fully exposed when the roller blind is in the open position, such that when viewing into the appliance at an angle there is essentially no diminishing of the viewing area.

The abstract of Japanese Patent Publication 09170761 shows a roller blind which can be actuated in front of the glass viewing window in the door of a recirculating stove. In this known case, however, as in the already described state of the art, the cover, that is, the roller blind, is arranged exteriorly at the stove. This is shown therein that in the drawing figure of this reference the window is shown with dash lines, that is, it is covered, in the closed condition thereof, by a roller blind that is arranged exteriorly. Such an exterior cover, however, detrimentally affects the outer appearance or appeal of the household appliance. In contrast to this reference, the roller blind according to the invention is arranged within the viewing window.

By way of an applicable material selection for the cover, there can also be achieved, to a considerable extent, a control of radiation emission from the interior of the household appliance, for example, heat radiation or, respectively, microwave radiation. It is therefore possible, according to at least one embodiment of the present invention, to reduce the loss of heat through a viewing door in a conventional stove or oven. It is further possible to therefore increase the amount of heat retained in the interior of the stove. In addition, the loss of heat through the viewing door of conventional stoves or ovens often produces uneven cooking temperatures in different regions of the interior of the stove, thus producing unevenly cooked food. By reducing the amount of heat lost through the viewing door, it is possible to reduce or restrict the formation of regions having uneven cooking temperatures in the interior of the stove.

The roller that can be driven of the cover, or blind, can be rotated from the exterior by way of a mechanical connection in manual manner, however, it is of greater comfort when, in accordance with one embodiment of the viewing window, or assembly, or arrangement, there is provided an electric-power drive-system for rotating the roller that is powered by a drive motor.

The above-mentioned embodiment can be simplified as to the configuration when, in accordance with one aspect of the invention, the pulling elements are provided by pulling ropes.

With respect to the configuration of the cover, or blind, there are numerous options. A particular advantage is provided when, in accordance with one embodiment of the invention, the roller blind, or curtain, is made of a plastic-synthetic foil that is tear resistant.

Such a foil can be made in simple manner from customary material.

Further embodiments of the invention are contained in dependent claims and in the following description of the invention with reference to an embodiment shown in the drawing figure.

The above-discussed embodiments of the present invention will be described further hereinbelow. When the word "invention" is used in this specification, the word "invention" includes "inventions", that is the plural of "invention". By stating "invention", the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiments which are illustrated in the accompanying drawings. There is shown in.

DESCRIPTION OF THE PREFERRED EMBODIMENT

Figure 1:
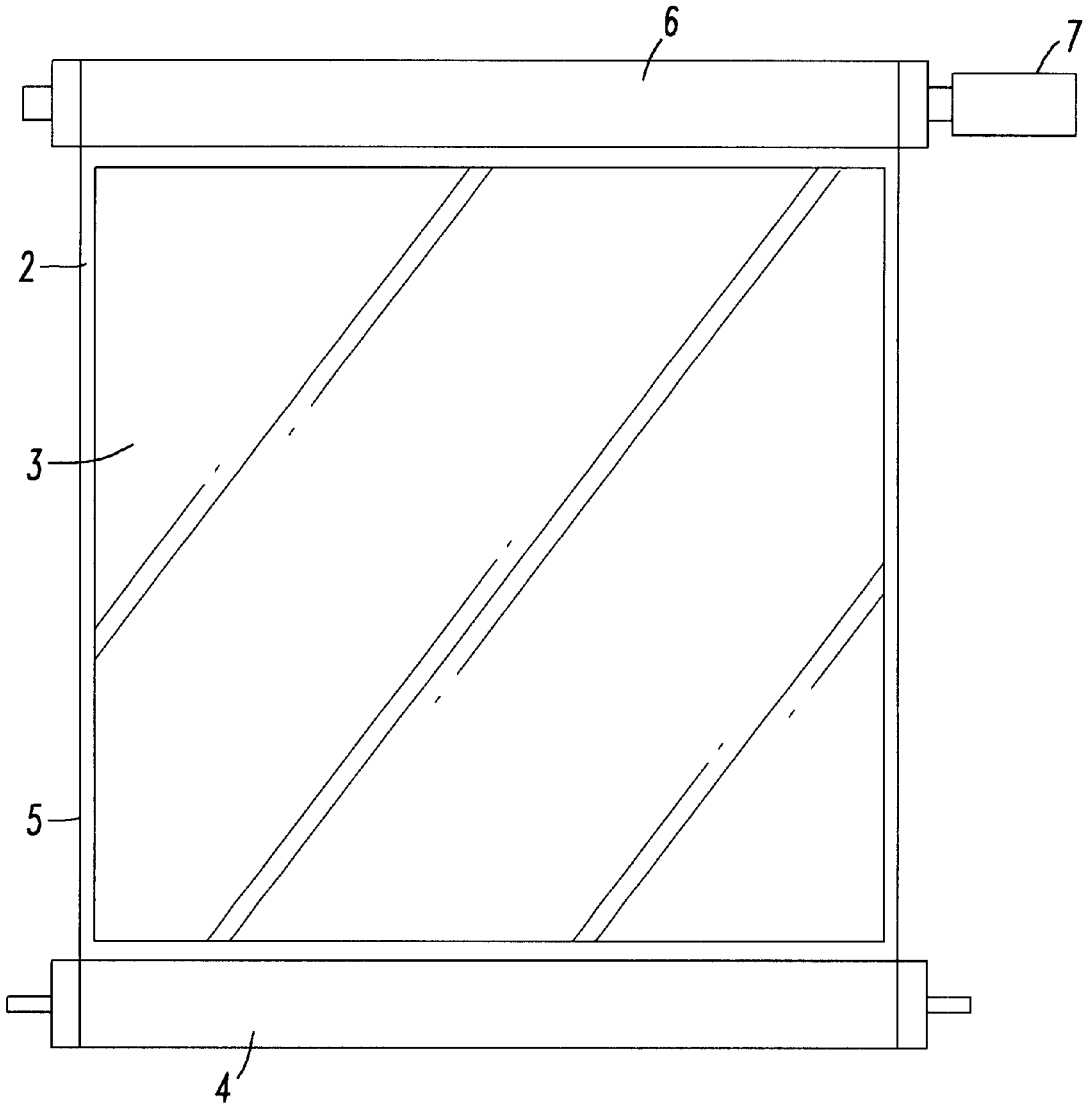
FIG. 1: in a front-view illustration, an embodiment with a roller blind as cover, which extends between two glass panes and which can be rolled onto and rolled from two rolls.
Figure 2:
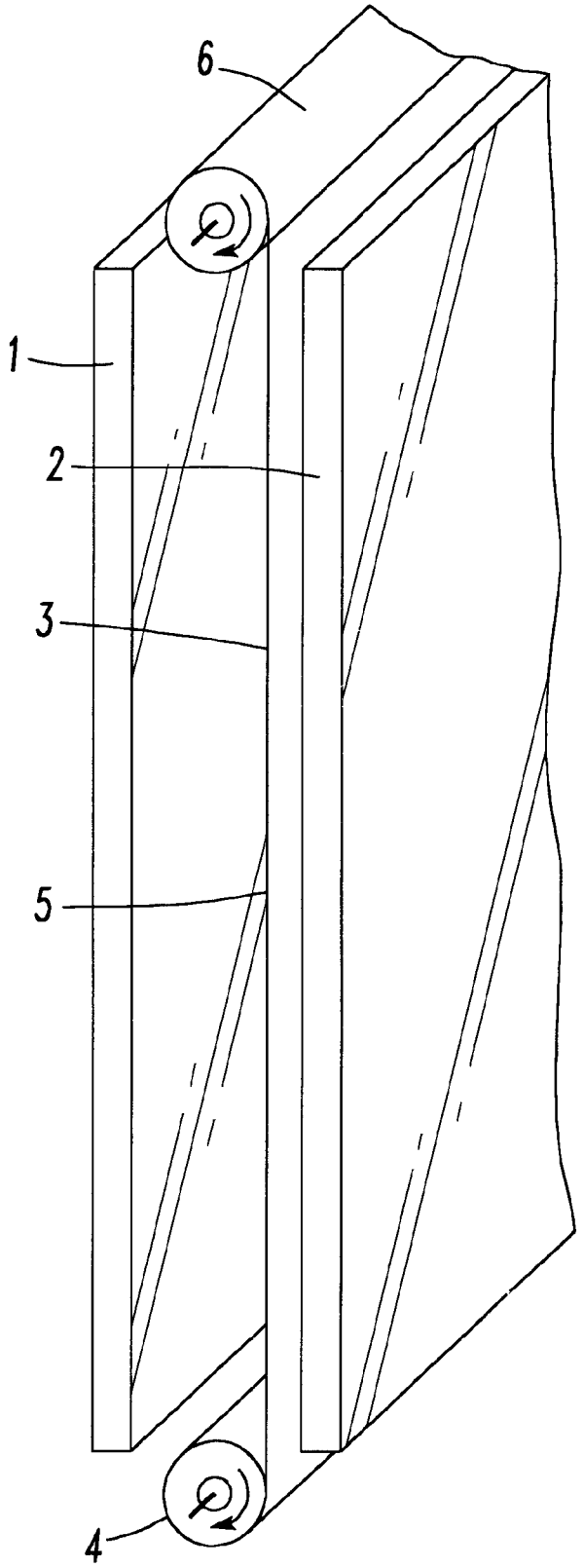
FIG. 2: a side view, in perspective illustration, of the embodiment of FIG. 1.

FIGS. 1 and 2 show a viewing window for a household appliance, which window can be mounted in the wall of the household appliance, this wall not being shown in this drawing Figure.

The viewing window comprises two transparent panes 1, 2 which, preferably, are comprised of glass panes, particularly glass panes which can be subjected to high thermal stressing. However, transparent plastic-synthetic panes may be utilized in accordance with the invention.

For the purpose of simplification of the representation, the frame construction for the mounting of the panes 1 and 2 is not further illustrated in this drawing Figure. This is in accordance with well-known configurations.

In the space between the two panes 1, 2 there is arranged a roller blind, or roller curtain, 3 which blind is movable in upward direction and in downward direction. This blind, or curtain, is typically comprised of a plastic-synthetic foil which is resistant to tearing. Other materials are within the scope of the invention.

By way of one end, the roller blind 3 is secured to a roller 4, which is configured like a self-winding, or rolling, curtain, or blind, which roller 4 has a torsion spring for rolling onto it the roller blind 3, and for tensioning the roller blind 3. The roller 4 is secured so as to rotate in suitable manner at the frame for the panes or, respectively, at the wall of the housing of the household appliance.

The other end of the roller blind 3 is connected, by way of pulling ropes 5, with a second roller 6, which second roller is secured at the upper pane frame or, respectively, at the wall of the housing of the household appliance, and securement being such as to allow rotation; and the second roller can be driven by an electric motor 7.

When the motor 7 is actuated, by way of an exterior push-button, or key, which is connected by conduits with the motor and a source of power, the roller blind 3 is pulled from the roller 4, by means of the pulling ropes 5, and against the force of the torsion spring, and thereby covers the viewing area of the viewing window to the desired extent, typically it fully covers the viewing area. By way of the pre-tensioning force of the torsion spring, the roller blind 3 remains in the tensioned condition. By means of a corresponding lock in the drive assembly 7, this condition is also maintained when the motor is not supplied with the supply current. When this lock is released, the roller blind 3 is rolled onto the lower roller 4, by means of the spring force of the pretensioned torsion spring, and thereby is unrolled from the upper roller 6. Thus, by way of the roller blind 3, which is substantially non-light-transmissive, the viewing area of the viewing window can be effectively closed, or screened, or occluded.

With corresponding selection of the material for the roller blind 3, not only the radiation in the visible range, but also the other components of the spectrum of the electromagnetic radiation, for example, microwave radiation having longer waves, can be screened, which is of particular importance, particularly for the prevention of radiation emission, or egress, through the viewing panes of microwave appliance. There is also possible a screening of heat radiation so as to lower the thermal impact on the outer pane.

The embodiment shown in FIGS. 1 and 2 is to be regarded as one embodiment of the invention. For example, in place of the pulling ropes 5, other connecting elements can be used. With respect to the configuration of the roller blind 3, many embodiments are provided, on the one hand, with respect to material, as well as, on the other hand, with respect to the design or construction.

In place of the motor 7, a manual actuator can be provided to rotate the upper roller 6.

As well, the position of the rollers 4 and 6 can be exchanged, that is, the roller blind is moved from above to below in front of the viewing window.

Figure 3:
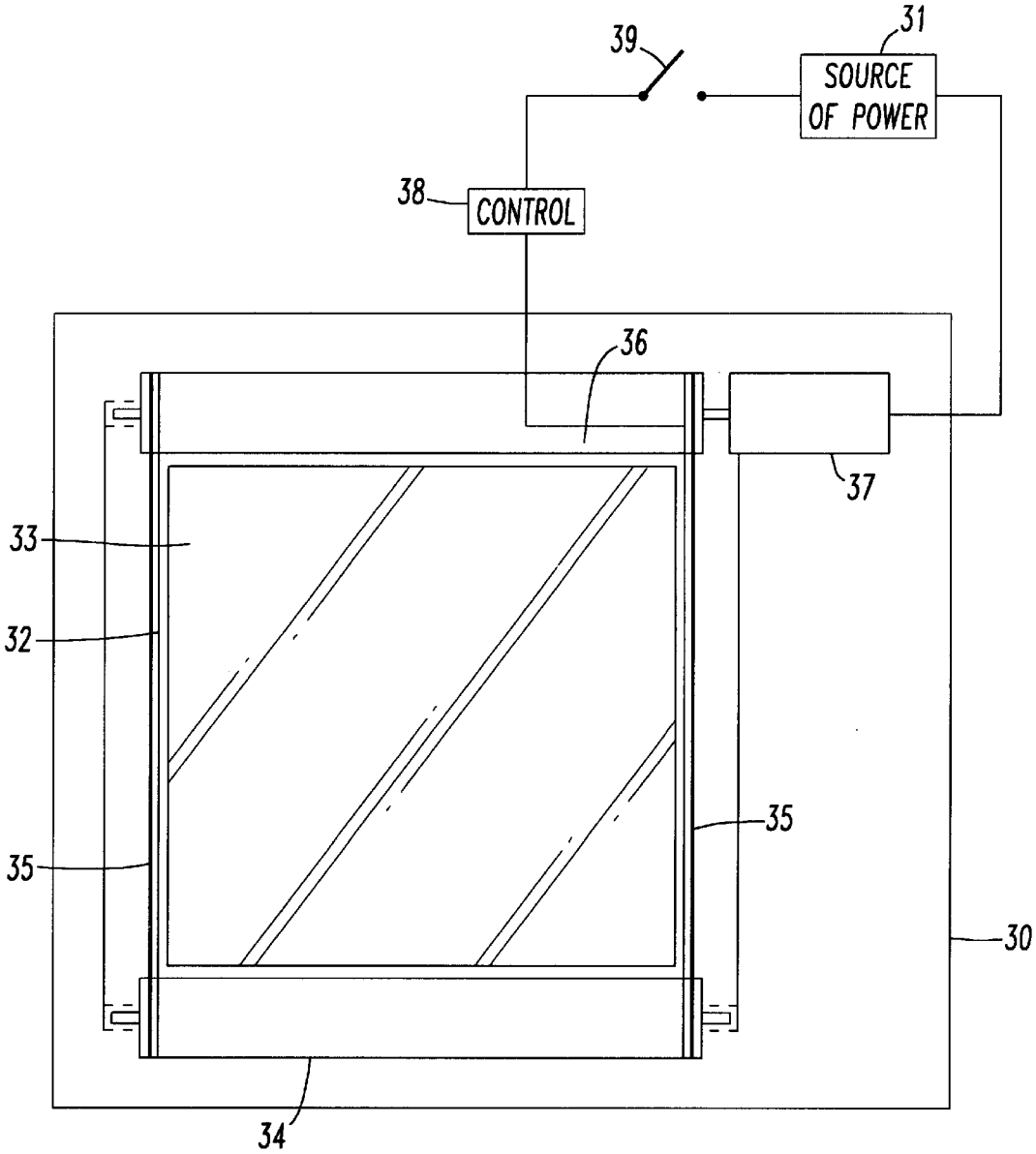
FIG. 3: is a view similar to FIG. 1 and showing additional details.

With reference to FIG. 3, a window assembly 30, as described above, comprises a roller blind 33 with connecting members 35 to connect the roller blind 33 to lower roller 34 and upper roller 36. Reference numeral 32 designates a window pane of the assembly. Upper roller 36 is powered by a motor 37 that is connected to a source of power 31. Actuation of the motor can be initiated by switch 39 closing the circuit. Control 38 provides control of the roller blind assembly. This may be integrated with other customary controls of the appliance or unit.

Figure 4:
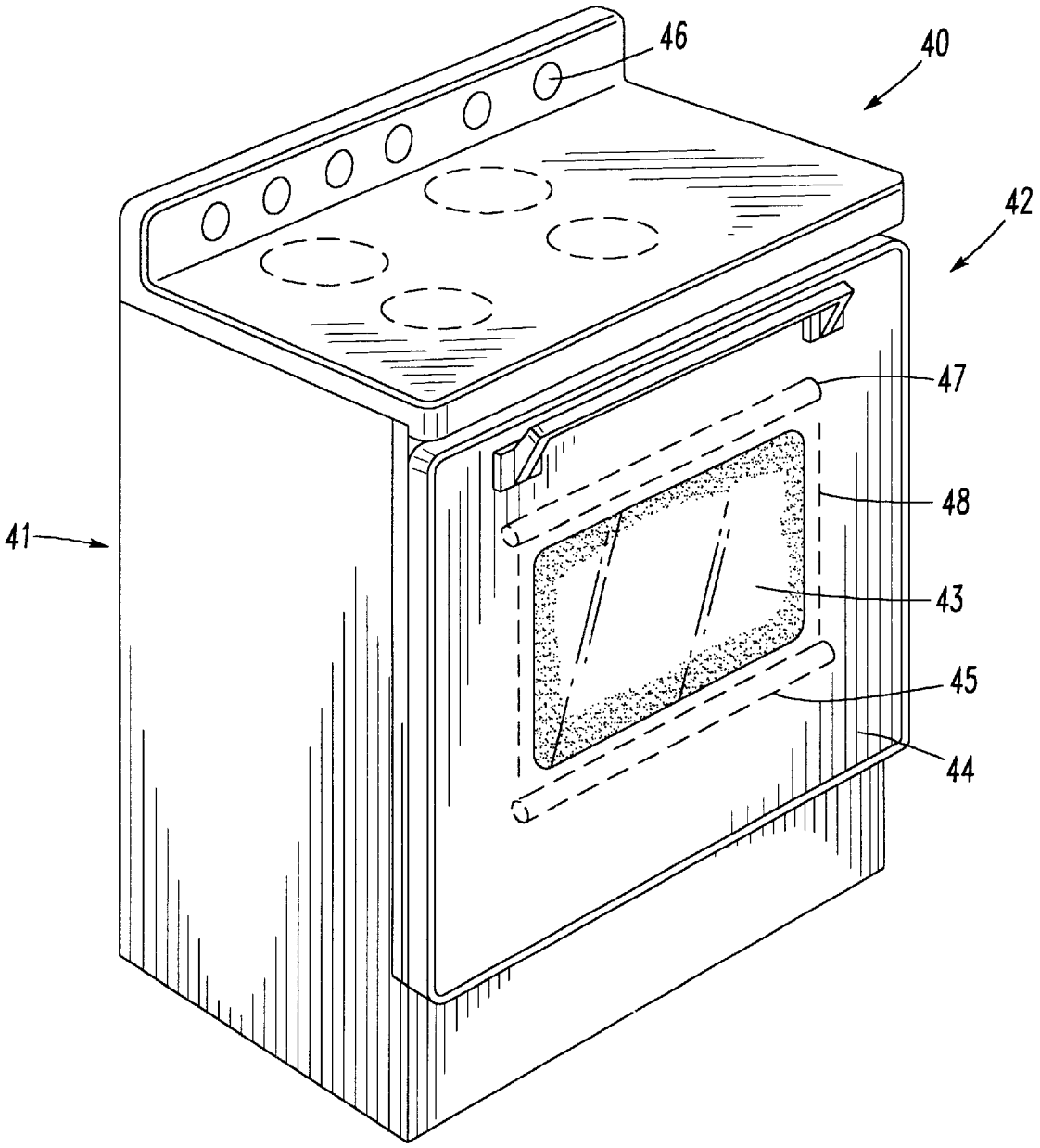
FIG. 4: is a perspective view of a stove with an oven embodying the present invention.

FIG. 4 shows a stove 41 with a smooth-top cooking surface 40 and an oven 42. The oven 42 comprises a window 43 in door 44. A roller blind comprising rollers 45 and 47, as has been described in detail in the foregoing, serves to cover or uncover the window 43. Control of the respective motor can be achieved by a switch or pushbutton 46.

Figure 5:
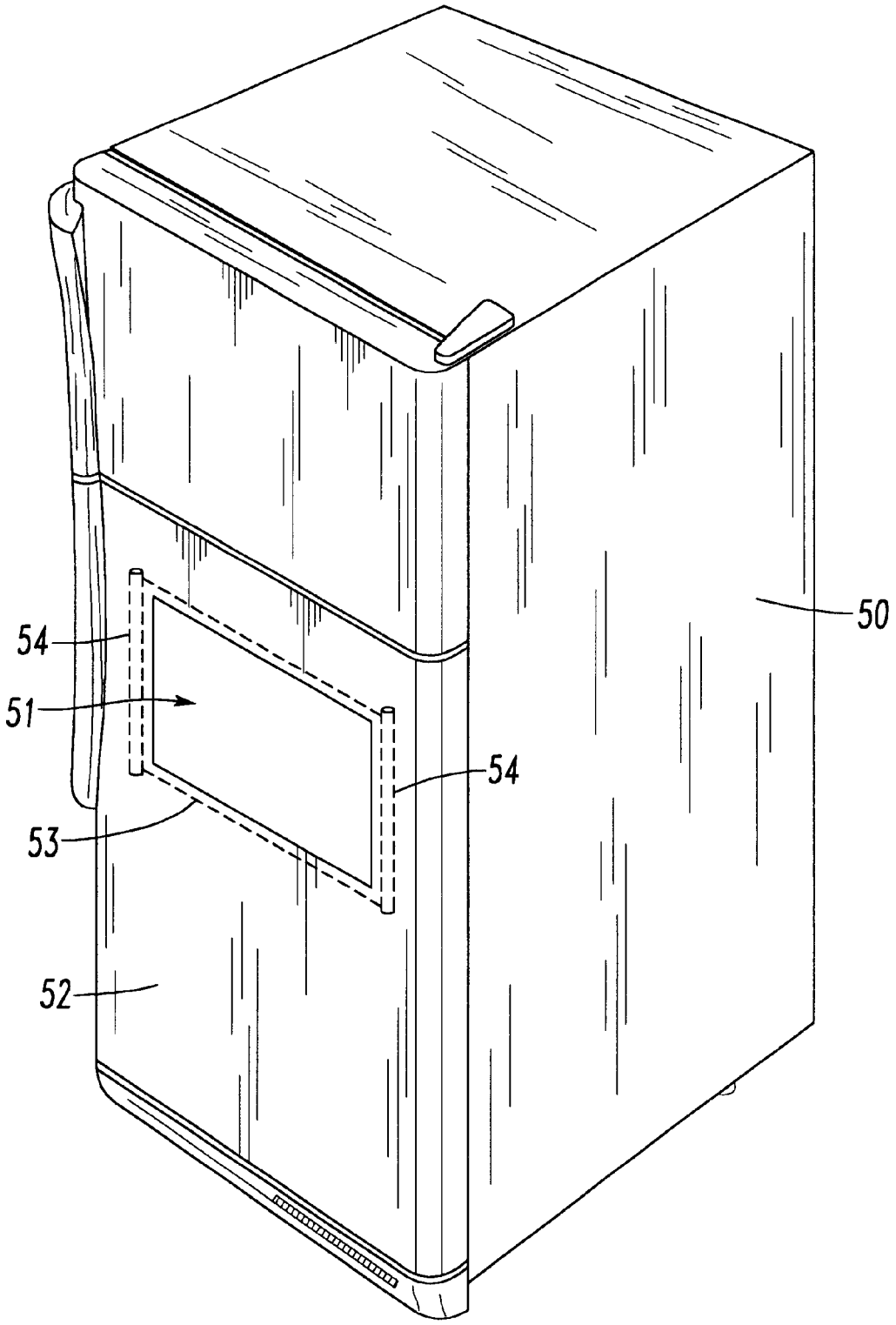
FIG. 5: is a perspective view of a refrigerator embodying the present invention.

FIG. 5 illustrates that the invention also has application to a refrigerator, or to a chest freezer, with a refrigerator being generally identified by reference numeral 50. The viewing area afforded by a window 51 in a door 52 can be obscured or uncovered to permit viewing of the interior of refrigerator 50 by a roller blind arrangement, as discussed above, comprising a blind 53 and rollers 54. Actuation of the roller blind can be by a switch, not shown, as has been described in the foregoing.

Figure 6:
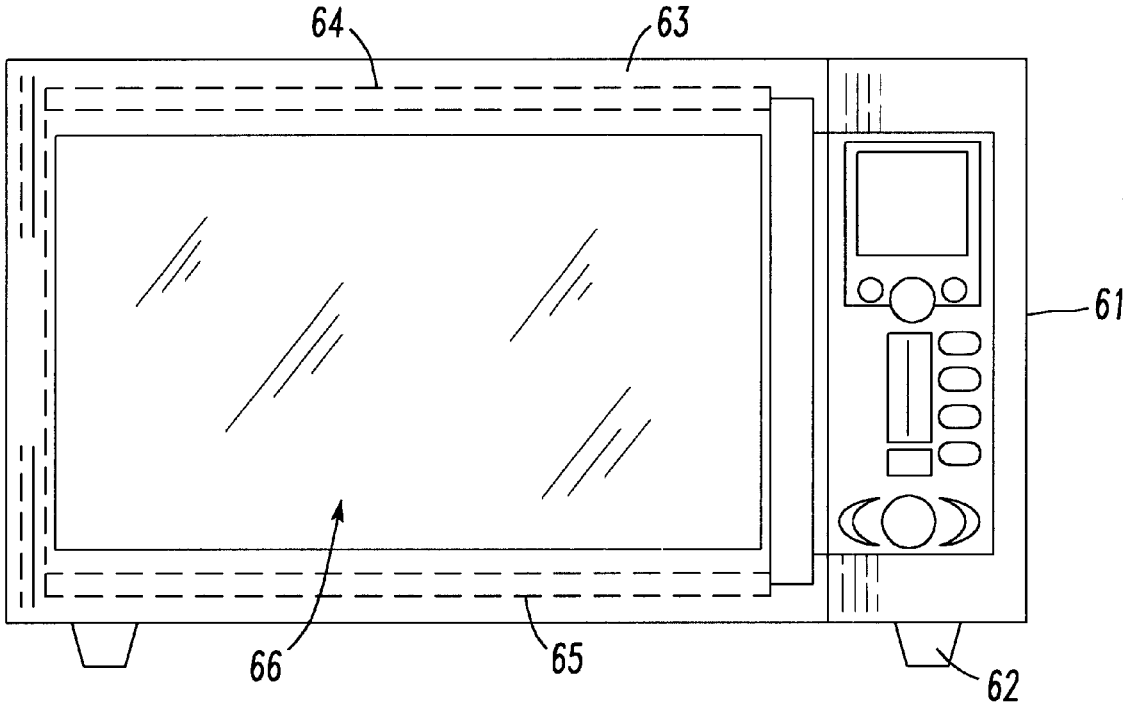
FIG. 6: is a perspective view of a microwave oven embodying the present invention.

A microwave oven embodiment is illustrated in FIG. 6. The microwave oven 61 has a door 63 with the roller blind assembly comprising rollers 64 and 65 to permit obscuring the viewing area and uncovering the window area 66 with blind material, as has been described in the foregoing.

Figure 7:
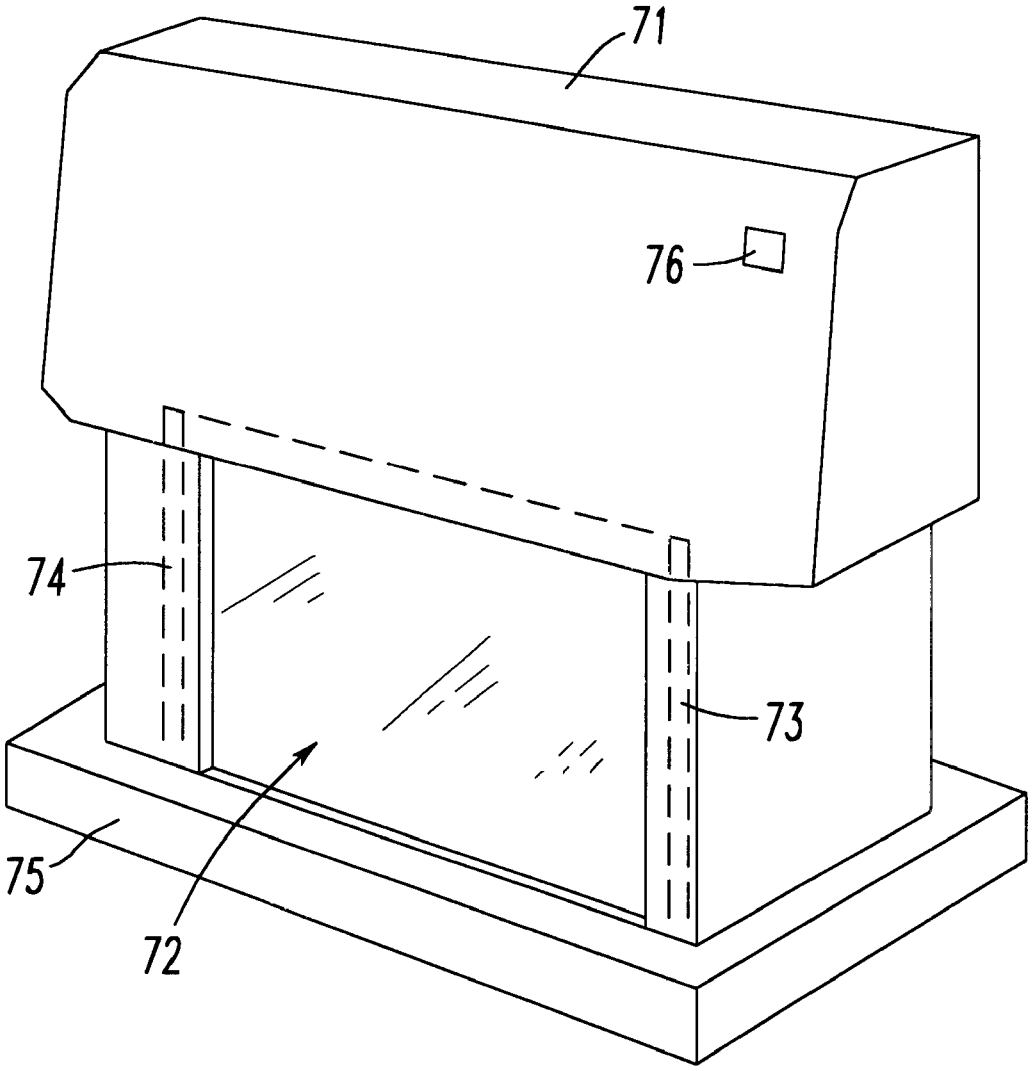
FIG. 7: is a perspective view of a fireplace with a fire screen embodying the present invention.

FIG. 7 illustrates the embodiment of a space heater 71 with viewing window assembly 72. Laterally arranged rollers 73 and 74 permit obscuring and opening the view of the interior of the space heater 71 in the manner discussed in the foregoing. Reference numeral 75 identifies a base of the space heater 71. The roller blind assembly, as discussed above, can be operated by way of pushbutton 76.

Figure 8:
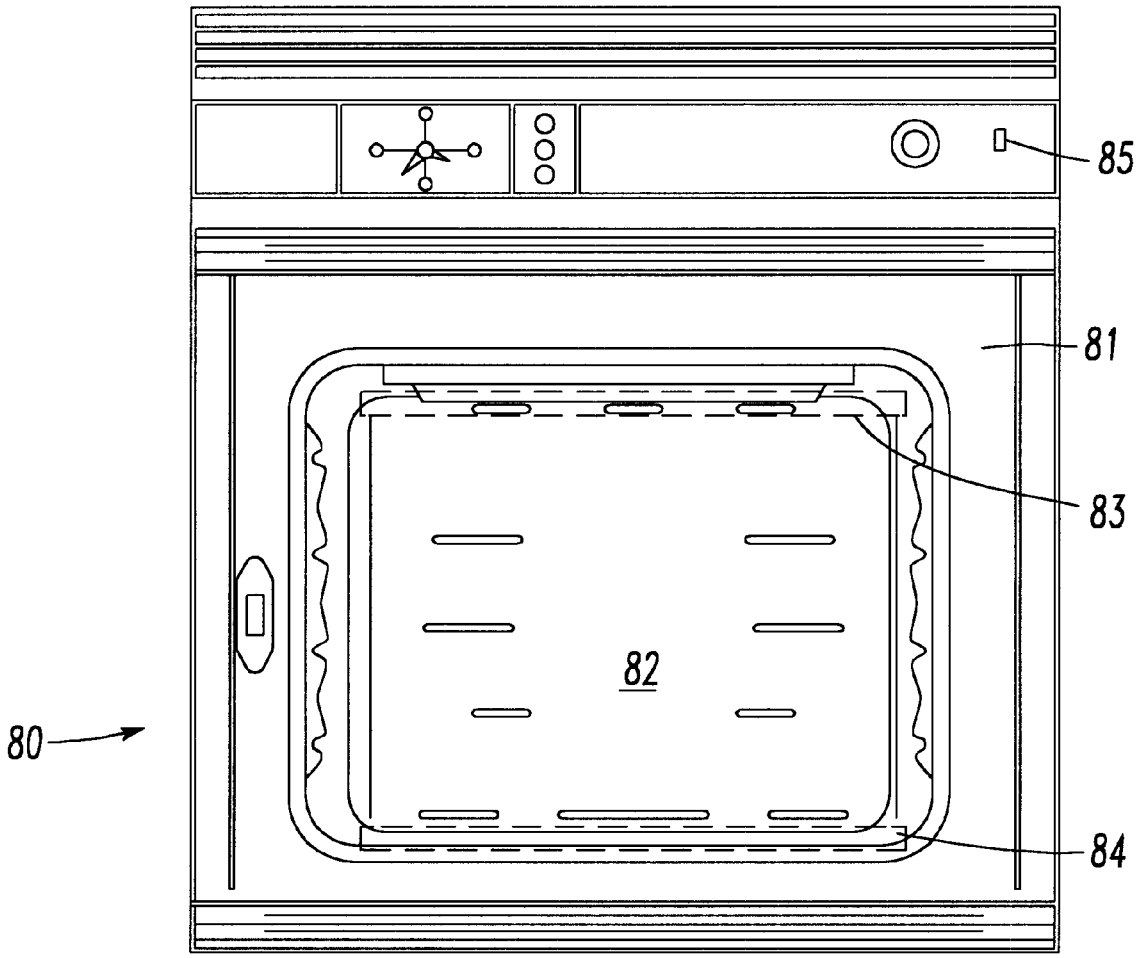
FIG. 8: is a front elevation of a stove with an oven embodying the present invention.

FIG. 8 illustrates a stove 80 with a door 81. A window assembly 82 can cover or uncover the interior by way of rollers 83 and 84, as has been described in the foregoing. Pushbutton 85 serves to actuate one or two drive units as described in the foregoing.

Figure 9:
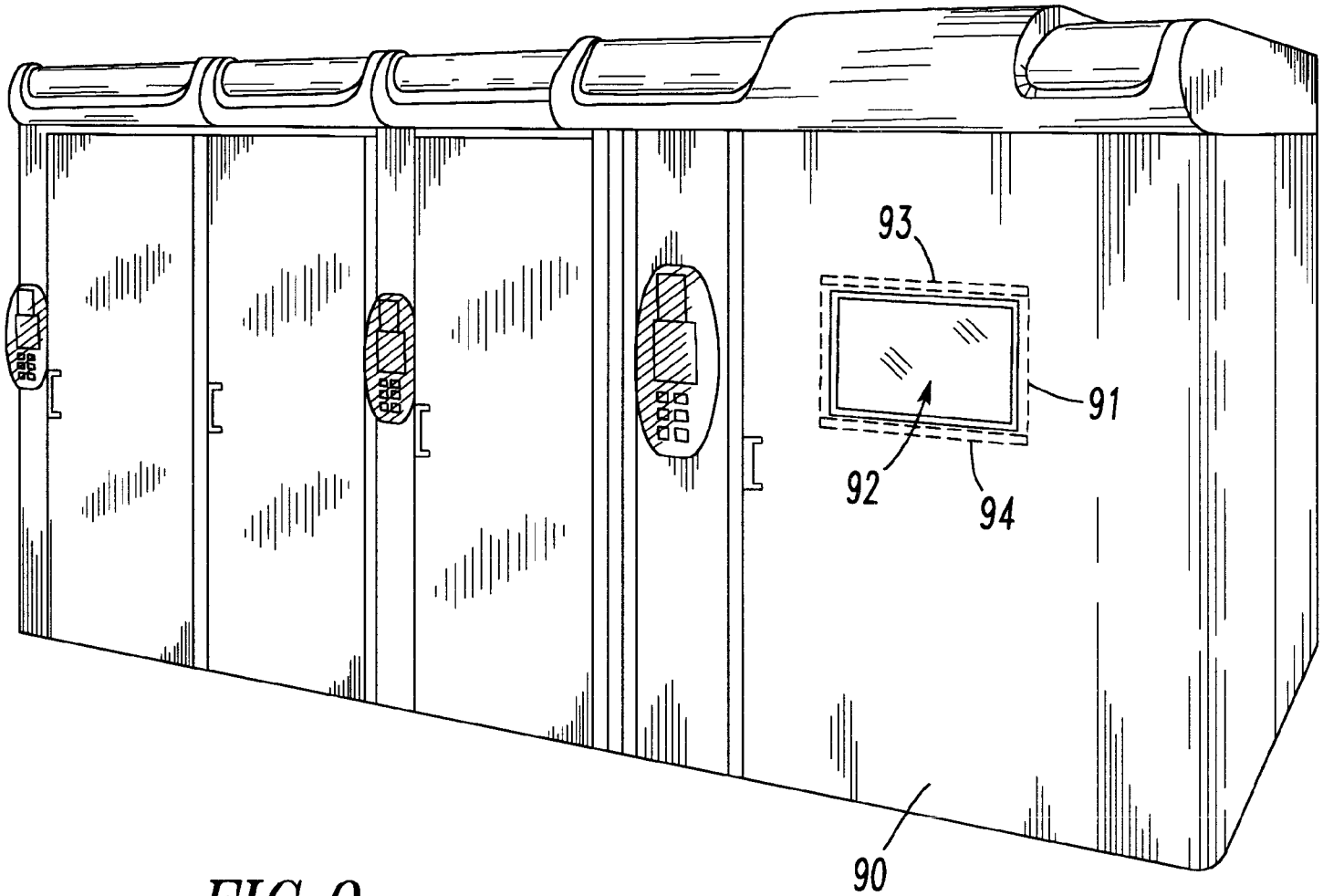
FIG. 9: is a perspective view of a commercial baking oven embodying the present invention.

FIG. 9 illustrates a commercial baking oven comprising a door 90 with a window assembly 91, as described in detail above. The blind material 92 can be wound on rollers 93 and 94 to obscure viewing the interior and can be unwound to permit viewing of the interior as discussed above. While one door has been shown to be equipped with a viewing assembly, it will be understood that the other doors of the unit may be similarly equipped.

The blind material may possibly comprise TEFLON or the like material to supply a substantial constant internal configuration for reflecting heat back into the interior of a stove, or the like appliance or unit, when in the closed position, i.e., when obscuring viewing of the interior of the appliance or unit.

One feature of the invention resides broadly in the viewing window for household appliances, which viewing window can be mounted or placed in a wall of the housing of the household appliance, and which window comprises at least two transparent panes 1, 2 arranged at a distance from one another, whereby between the two transparent panes 1, 2 there is contemplated a screen, or cover, 3 which covers, or closes, the viewing area, and which screen is adjustable from the exterior of the appliance, characterized thereby that the cover is configured like a roller blind, or curtain, 3, which has two rollers 4, 6, of which one is arranged adjacent to the viewing window at the top and the other is arranged adjacent to the viewing window at the bottom, and one of which rollers comprises a torsion spring, as is typical for a self-winding roller blind, and the other roller can be driven, and that one end of the roller blind 3 is secured to the roller 4 comprising the torsion spring and the other end of the roller blind is connected, by way of pulling elements 5, to the roller 6 that can be driven.

Another feature of the invention resides broadly in a viewing window, characterized thereby that an electric-power drive-system is provided for rotating the roller 6 that can be driven.

Yet another feature of the invention resides broadly in a viewing window, characterized thereby that the pulling elements are configured as pulling ropes 5.

Still another feature of the invention resides broadly in a viewing window, characterized thereby that the roller blind 3 is configured as a plastic-synthetic foil that is resistant to tearing.

Another feature of the invention resides broadly in a stove for cooking food, the stove comprising a stove body being configured with a support comprising feet, and the stove body being configured with an interior confined by walls comprising side walls, a front wall, and a rear wall. The stove has an oven, a heating arrangement configured and disposed to provide heating to cook food in the oven, and control apparatus to control the heating arrangement. There is also provided a door in the front wall, which door comprises a window arrangement configured with a viewing area to view food being cooked in the interior of the oven. The window arrangement comprises comprising a first pane and a second pane disposed at a distance from the first pane. The first pane becomes the inner pane upon installation in the stove, and the second pane becomes an outer pane upon installation in the stove. An arrangement is provided to maintain the first and second panes in spaced relationship. A roller blind arrangement is disposed between the first and second panes, which roller blind arrangement comprises a portion to obscure viewing into the interior of the stove, and a portion to permit viewing into the oven. There is also provided an arrangement to move the portion to permit viewing into the stove, and to move the portion to obscute viewing into the interior of the, with the roller blind arrangement being configured to obscure the viewing area of the window to minimize heat radiation from the heating arrangement reaching the ambient surrounding of the stove and to minimize radiation and to provide a uniform heat reflection impinging upon the closed roller blind arrangement to thus supply a substantial constant internal configuration for reflecting heat back into the stove interior.

A further feature of the invention resides broadly in stove, in which the roller blind arrangement comprises a first roller being positioned at one side of the viewing area and a second roller positioned at the other side of the viewing area when installed. A roller blind material is connected between the first and second rollers and is configured to move from a position to obscure viewing into the interior of the oven to a position to permit viewing into the oven. There are also provided apparatus to power at least one of the first and second rollers, to roll said roller blind material from a position to obscure viewing into the interior of the oven to a position to permit viewing into the oven, and back from the position to permit viewing into the oven to the position to obscure viewing into the oven; and, further, connecting members connected to the first and second rollers and the roller blind material to move the roller blind material from the position to obscure viewing into the interior of the oven to a position to permit viewing into the oven, and back from the position to permit viewing into the oven to the position to obscure viewing into the oven.

Still another feature of the invention resides broadly in a stove, wherein the apparatus to power comprises a device to supply torsional force to the second roller to roll the blind onto the second roller to thereby permit viewing into the oven from the position to obscure viewing into the interior of the oven to a position to permit viewing into the oven, and back from the position to permit viewing into the oven to the position to obscure viewing into the oven.

Yet another feature of the invention resides broadly in a stove for cooking food comprising a stove body being configured with a support comprising feet. The stove body is configured with an interior confined by walls comprising side walls, a front wall, and a rear wall. The stove comprises at least one heat source, a heating arrangement configured to provide heating to cook food in the interior of the stove, and control apparatus to control the heating arrangement. The stove further comprises a door in the front wall, with the door comprising a window arrangement configured with a viewing area to view food being cooked in the interior of the stove. The window arrangement has a first pane and a second pane disposed at a distance from the first pane, with the first pane becoming the inner pane upon installation in the stove and the second pane becoming an outer pane upon installation in the stove. There is further provided an arrangement to maintain the first and second panes in spaced relationship and a roller blind arrangement disposed between the first and second panes. This roller blind arrangement comprises comprising a portion to obscure viewing into the interior of the stove, and a portion to permit viewing into the stove. There is also provided an arrangement to move the portion of the roller blind to permit viewing into the stove and to move the portion to obscure viewing into the interior of said stove. Thus, the roller blind arrangement is configured to obscure the viewing area of the window to minimize heat radiation from the heating arrangement reaching the ambient surrounding of the stove and to minimize radiation and to provide a uniform heat reflection impinging upon the closed roller blind arrangement to thus supply a substantial constant internal configuration for reflecting heat back into the stove interior.

Still another feature of the invention resides broadly in a viewing window for household appliances, which viewing window can be mounted or placed in a wall of the housing of the household appliance, with said window comprising at least two transparent panes arranged at a distance from one another and providing a viewing area. A screen is disposed between said at least two transparent panes to obscure the viewing area. There is also provided an arrangement to adjust the screen from the exterior of the appliance. This screen being configured with a pair of rollers; one roller being arranged adjacent to the viewing window at the top and the other roller being arranged adjacent to the viewing window at the bottom. At least one of the pair of rollers comprises comprising at least one of (i.) and (ii.): (i.) a torsion spring, as is typical for a self-winding roller blind; and (ii.) an electric-power drive-system, with one end of the screen being secured to the roller comprising the torsion spring and the other end of the screen being secured to the roller that can be driven by the drive-assembly. There are also provided connecting elements to connect the pair of rollers and the screen to move the screen from the position to obscure the viewing area to a position to permit viewing through the viewing area, and back from the position to permit viewing through the viewing area to the position to obscure the viewing area.

A further feature of the invention resides broadly in a viewing window wherein the connecting elements comprise pulling ropes.

At least one additional embodiment of the present invention relates to various household appliances such as baking appliances and cooking appliances, microwave appliances, cooling and/or refrigeration appliances, and space heaters, typically comprising a viewing window which allows viewing of the interior of the appliance. The viewing window that can be mounted or placed in a wall of the housing of the household appliance typically comprises at least two transparent panes (1, 2) arranged at a distance from one another. So as to temporarily preclude the viewing of the interior of the appliance in a desire manner, the invention contemplates that between the two transparent panes (1, 2) there is provided a screen (3) which covers, or closes, the viewing area, and which screen (3) is adjustable from the exterior of the appliance. The screen, or cover, is configured as roller blind, or curtain, (3) which can be rolled up and rolled down in vertical direction by means of two roller (4, 6).

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal republic of Germany Application No. 100 32 733.8-16, filed on Jul. 5, 2000, having inventors Kurt LEUTNER and Oliver GROS, and DE-OS 100 32 733, and DE-PS 100 32 733, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

All of the patent references and their published equivalents anywhere, and the references in which they are cited, are hereby incorporated by reference as if set forth in their entirety herein.

The details in the patents, patent applications and publications may be considered to be incorporable, at Applicants' option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses, if any, are intended to cover the structures described herein as performing the recited function and not only structural equivalents but also equivalent structures.

Some examples of roll shutters with torsion spring rewinding, features of which may possibly be used or possibly adapted for use in a possible embodiment of the invention may be found in the following U.S. Pat. Nos. 5,938,136; 5,975,186; 6,021,837; 6,095,224; 6,095,225; and 6,244,325. All of the foregoing patents are hereby incorporated by reference as if set forth in their entirety herein.

Some examples of apparatus for opening and closing a window shade, features of which may possibly be used or possibly adapted for use in a possible embodiment of the invention may be found in the following U.S. Pat. Nos. 4,865,109; 5,803,148; and 6,234,417. All of the foregoing patents are hereby incorporated by reference as if set forth in their entirety herein.

Some examples of roll shutters, features of which may possibly be used or possibly adapted for use in a possible embodiment of the invention may be found in the following U.S. Pat. Nos. 4,691,753; 4,846,242; and 6,054,921. All of the foregoing patents are hereby incorporated by reference as if set forth in their entirety herein.

Some further examples of window shades, actuators, pulley ropes, and drive devices therefor, features of which may possibly be used or possibly adapted for use in a possible embodiment of the invention may be found in the following U.S. Pat. Nos. 2,105,469; 4,674,550; 4,681,279; 5,137,073; 5,546,927; 6,047,759; 6,100,659; 6,186,211; and 6,201,364. All of the foregoing patents are hereby incorporated by reference as if set forth in their entirety herein.

Some examples of roller blinds, features of which may possibly be used or possibly adapted for use in a possible embodiment of the present invention may be found in the following U.S. Pat. Nos. 4,413,665; 4,502,522; 4,884,618; 5,123,473; 5,414,334; 5,540,269; 5,609,196; 5,655,587; 5,718,277; 5,819,831; and 5,847,525. All of the foregoing patents are hereby incorporated by reference as if set forth in their entirety herein.

Some further examples of window shades, features of which may possibly be used or adapted for use in a possible embodiment of the invention may be found in the following U.S. Pat. Nos. 3,098,286; 3,115,927; 3,274,676; 4,006,770; 4,009,745; 4,346,749; 4,653,567; 4,674,550; 6,131,642; and 6,135,186. All of the foregoing patents are hereby incorporated by reference as if set forth in their entirety herein.

Some examples of tear and/or heat resistant foils, or films, or screens, features of which may possibly be used or possibly adapted for use in a possible embodiment of the present invention may be found in the following U.S. Pat. Nos. 3,984,592; 4,029,835; 4,043,063; 4,224,376; 4,238,534; 4,565,663; 4,621,009; 4,702,968; 4,810,571; 4,943,459; 4,977,230; 5,045,404; 5,272,194; 5,316,839; 5,688,156; and 5,885,673. All of the foregoing patents are hereby incorporated by reference as if set forth in their entirety herein.

Some further example of self-winding shades or blinds, features of which may possibly be used or adapted for use in a possible embodiment of the invention may be found in the following foreign Patents: DE 195 13 925 C2; DE 87 17 270 U1; DE 87 13 816.6 U1; WO 98/24657; DE 197 54 557 C1; DE 198 17 317 A1; and FR 2,665,244. All of the foregoing patents are hereby incorporated by reference as if set forth in their entirety herein.

Some examples of stoves, ranges and related components which could possibly be utilized or incorporated in at least one possible embodiment of the present invention may be found in the following U.S. Pat. No. 5,679,273, issued on Oct. 21, 1997; U.S. Pat. No. 5,464,005, issued on Nov. 7, 1995; U.S. Pat. No. 5,448,036, issued on Sep. 5, 1995; U.S. Pat. No. 5,429,114, issued on Jul. 4, 1995; U.S. Pat. No. 5,425,353, issued on Jun. 20, 1995; U.S. Pat. No. 5,406,932, issued on Apr. 8, 1995; U.S. Pat. No. 5,400,765, issued on Mar. 28, 1995; U.S. Pat. No. 5,400,766, issued on Mar. 28, 1995; U.S. Pat. No. 5,380,985, issued on Jan. 10, 1995; U.S. Pat. No. 5,377,660, issued on Jan. 3, 1995; U.S. Pat. No. 5,343,020, issued on Aug. 30, 1994; U.S. Pat. No. 5,290,997, issued on Mar. 1, 1994; U.S. Pat. No. 5,280,152, issued on Jan. 18, 1994; U.S. Pat. No. 5,245,159, issued on Sep. 14, 1993; U.S. Pat. No. 5,220,155, issued on Jun. 25, 1993; U.S. Pat. No. 5,213,091, issued on May 25, 1993; U.S. Pat. No. 4,997,302, issued on Dec. 11, 1990; U.S. Pat. No. 4,597,374, issued on Jul. 1, 1986; U.S. Pat. No. 4,438,210, issued on Mar. 20, 1984; U.S. Pat. No. 4,360,567, issued on Nov. 23, 1982; U.S. Pat. No. 4,351,998, issued on Sep. 28, 1982; U.S. Pat. No. 4,320,275, issued on Mar. 16, 1982; U.S. Pat. No. 4,163,141, issued on Jul. 31, 1979; U.S. Pat. No. 3,941,117, issued on Mar. 2, 1976.

The following U.S. Patents are hereby incorporated by reference as if set forth in their entirety herein as follows: U.S. Pat. No. 6,148,812, entitled "Cooking unit, such as a stove, for cooking food" issued to Taplan et al., on Nov. 21, 2000; U.S. Pat. No. 6,111,229, entitled "Cooking appliance such as a stove with arrangement of a ceramic heating element as a cooking zone in a cutout of a cooking space" issued to Schultheis, on Aug. 29, 2000; U.S. Pat. No. 6,050,176, entitled "Arrangement of hot plate in a cook top" issued to Schultheis et al., on Apr. 18, 2000; U.S. Pat. No. 6,002,112, entitled "Cooking appliance, such as a stove, with a glass-ceramic hob or cooktop with a rapid cooking ring or hotplate" issued to Nass et al., on Dec. 14, 1999.

The following references, also referred to above, are to be incorporated by reference, namely: DE 91 08 355 U1 and Japanese Patent Abstract 09170761 A. These are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A stove for cooking food, said stove comprising:

a stove body;

said stove body being configured with a support comprising feet;

said stove body being configured with an interior confined by walls comprising side walls, a front wall, and a rear wall;

an oven;

a heating arrangement configured and disposed to provide heating to cook food in said oven;

control apparatus to control said heating arrangement;

a door in said front wall;

said door comprising a window arrangement configured with a viewing area to view food being cooked in the interior of said oven;

said window arrangement comprising a first pane and a second pane disposed at a distance from said first pane;

said first pane becoming the inner pane upon installation in said stove;

said second pane becoming an outer pane upon installation in said stove;

an arrangement to maintain said first and second panes in spaced relationship; and a roller blind arrangement disposed between said first and second panes;

said roller blind arrangement comprising:

a first roller;

said first roller comprising an elongated, round cylindrical structure having a length;

a sheet connected to said first, cylindrical, roller;

said sheet comprising a continuous sheet having a width and a length;

said width of said sheet being approximately equal to said length of said first, cylindrical, roller;

said sheet being configured to be wound onto said first, cylindrical, roller and said sheet being configured to be unwound from said first, cylindrical, roller; and actuating apparatus configured and disposed to position said sheet into a first position, to obscure viewing into the interior of said oven, upon said sheet being unwound from said first, cylindrical, roller;

said actuating apparatus further being configured and disposed to position said sheet into a second position, to permit viewing into the interior of said oven, upon said sheet being wound onto said first, cylindrical, roller;

said sheet being configured, when in said first position:

to obscure viewing into the interior of said oven, to minimize heat radiation from said heating arrangement reaching the ambient surrounding of said stove, to provide a substantially uniform heat reflection of heat impinging upon said sheet, and to provide a substantially uniform heat reflection of impinging heat into said oven from all portions of the interior of said oven.

2. The stove according to claim 1, wherein:

said window arrangement comprises a first side and a second side opposite said first side;

said first, cylindrical, roller is mounted for rotation and positioned at said first side of said window arrangement;

said roller blind arrangement comprises:

a second roller;

said second roller being mounted for rotation and being positioned at said second side of said window arrangement when installed; and a pair of flexible elongated members connected to said first and second rollers;

said sheet comprises a material connected between said pair of flexible elongated members;

said sheet material being wound onto said first, cylindrical, roller to effectuate said second position to permit viewing into the interior of said oven;

a portion of each said pair of flexible elongated members being wound onto said first, cylindrical, roller;

said actuating apparatus comprises:

apparatus configured to rotate said second roller:

to unwind of said sheet material from said first, cylindrical, roller into said first position to obscure viewing into the interior of said oven; and to wind a portion of each of said pair of flexible elongated members from said first, cylindrical, roller onto said second roller;

said rotating apparatus being configured to rotate said first, cylindrical, roller:

to wind said sheet material onto said first, cylindrical, roller from said first position, to obscure viewing into the interior of said oven, into said second position to permit viewing into the interior of said oven; and to unwind a portion of each of said pair of flexible elongated members from said second roller onto said first, cylindrical, roller.

3. The stove according to claim 2, wherein:

said rotating apparatus comprises:

a device disposed to supply a torsional force to said first, cylindrical, roller;

said torsional device being configured to permit unwinding of said sheet material from said first, cylindrical, roller into said first position to obscure viewing into the interior of said oven; and said torsional device being configured store a sufficient torsional force to rotate said first, cylindrical, roller to wind said sheet material onto said first, cylindrical, roller into said second position to permit viewing into the interior of said oven.

4. The stove according to claim 3, wherein:

said rotating apparatus comprises:

an electric-power drive-system disposed to rotate said second roller;

said electric-power drive-system being configured to provide a sufficient power to rotate said second roller to effectuate unwinding of said sheet material from said first, cylindrical, roller from said second position, to permit viewing into the interior of said oven, into said first position to obscure viewing into the interior of said oven;

said electric-power drive-system being configured to permit said torsional device of said first, cylindrical, roller to wind said sheet material onto said first, cylindrical, roller from said first position, to obscure viewing into the interior of said oven, into said second position to permit viewing into the interior of said oven; and said electric-power drive-system comprises switch apparatus to actuate said electric-power drive-system from the exterior of said stove.

5. The stove according to claim 4, wherein:

said flexible elongated members comprise a material configured to withstand the heat generated by said heating arrangement.

6. The stove according to claim 5, wherein:

said sheet material comprises a material having a substantial resistance to tearing.

7. The stove according to claim 6, wherein:

said sheet material comprises TEFLON.

8. An oven for preparing food for consumption, said oven comprising:

an oven body;

said oven body being configured with an interior confined by walls comprising side walls, a rear wall, and a door;

a heating arrangement configured to provide heating to prepare food in the interior of said oven;

control apparatus to control said heating arrangement;

said door comprising a window arrangement configured with a viewing area to view food being prepared in the interior of said oven;

said window arrangement comprising a first pane and a second pane disposed at a distance from said first pane;

said first pane becoming the inner pane disposed towards the interior of said oven upon said door being closed;

said second pane becoming the outer pane disposed towards the exterior of said oven upon said door being closed;

an arrangement to maintain said first and second panes in spaced relationship;

a blind arrangement disposed between said first and second panes;

said blind arrangement comprising:

a first roller;

said first roller comprising an elongated, round cylindrical structure;

a sheet connected to said first, cylindrical, roller;

said sheet comprising a continuous sheet;

said first, cylindrical, roller and said sheet being configured and disposed to permit winding of said sheet onto said first, cylindrical, roller, and also to permit unwinding of said sheet from said first, cylindrical, roller;

actuating apparatus configured and disposed to position said sheet into a first position to obscure viewing into the interior of said oven;

said actuating apparatus further being configured and disposed to position said sheet on said first, cylindrical, roller into a second position to permit viewing into the interior of said oven;

said sheet being configured, when in said first position:

to obscure viewing into the interior of said oven, to minimize heat radiation from said heating arrangement reaching the ambient surrounding of said oven, and to provide a heat reflection of heat impinging upon said sheet into said oven.

9. The oven according to claim 8, wherein:

said window arrangement comprises a first side and a second side opposite said first side;

said first, cylindrical, roller is mounted for rotation and positioned at said first side of said window arrangement;

said oven comprising:

a second roller;

said second roller is mounted for rotation and is positioned at said second side of said window arrangement when installed; and a pair of flexible elongated members connected to said first and second rollers;

said sheet being connected between said pair of flexible elongated members;

said sheet being wound onto said first, cylindrical, roller to effectuate said second position to permit viewing into the interior of said oven;

a portion of each of said pair of flexible elongated members is wound onto said first, cylindrical, roller;

said actuating apparatus comprises:

apparatus configured to rotate said second roller:

to unwind said sheet from said first, cylindrical, roller into said first position to obscure viewing into the interior of said oven; and to wind a portion of each of said pair of flexible elongated members from said first, cylindrical, roller onto said second roller;

said rotating apparatus being configured to rotate said first, cylindrical, roller:

to wind said sheet onto said first, cylindrical, roller from said first position, to obscure viewing into the interior of said oven, into said second position to permit viewing into the interior of said oven; and to unwind a portion of each of said pair of flexible elongated members from said second roller onto said first, cylindrical, roller.

10. The oven according to claim 9, wherein said rotating apparatus comprises:

a device disposed to supply a torsional force to said first, cylindrical, roller;

said torsional device being configured to permit unwinding of said sheet from said first, cylindrical, roller into said first position to obscure viewing into the interior of said oven; and said torsional device being configured store a sufficient torsional force to rotate said first, cylindrical, roller to wind said sheet onto said first, cylindrical, roller into said second position to permit viewing into the interior of said oven.

11. The oven according to claim 10, wherein:

said rotating apparatus comprises:

an electric-power drive-system configured and disposed to rotate said second roller;

said electric-power drive-system being configured to provide a sufficient power to rotate said second roller to effectuate unwinding of said sheet from said first, cylindrical, roller from said second position, to permit viewing into the interior of said oven, into said first position to obscure viewing into the interior of said oven; and said electric-power drive-system being configured to permit said torsional device of said first, cylindrical, roller to wind said sheet onto said first, cylindrical, roller from said first position, to obscure viewing into the interior of said oven, into said second position to permit viewing into the interior of said oven; and said electric-power drive-system comprises switch apparatus to actuate said electric-power drive-system from the exterior of said oven.

12. The oven according to claim 11, wherein:

said flexible elongated members comprise a material configured to withstand the heat generated by said heating arrangement.

13. The oven according to claim 12 comprising one of:

said sheet comprises a material having a substantial resistance to tearing; and said sheet comprises TEFLON.

14. An appliance, comprising one of: an oven, a stove, a baking appliance, a cooking appliance, a refrigerator, a freezer chest, a freezer, a microwave appliance, and a space heater, said appliance comprising a viewing window, said viewing window being configured to be mounted in or form at least a portion of a wall of said appliance, said viewing window comprising:

at least two transparent panes arranged at a distance from one another and providing a viewing area;

an arrangement to maintain said first and second panes at a distance from one another;

a blind arrangement disposed between said at least two transparent panes;

said blind arrangement comprising:

a continuous sheet;

a first roller comprising an elongated, round cylindrical structure;

said sheet being connected to said first, cylindrical, roller;

said first, cylindrical, roller and said sheet being configured and disposed to permit winding of said sheet onto said first, cylindrical, roller, and also to permit unwinding of said sheet from said first, cylindrical, roller;

an actuating apparatus being configured and disposed to wind said sheet upon said first, cylindrical, roller to permit viewing through said window;

said actuating apparatus further being configured and disposed to unwind said sheet from said first, cylindrical, roller to obscure viewing through said window;

said sheet being configured, when unwound from said first, cylindrical, roller:

to obscure viewing through said window, to minimize temperature variations in the interior of the appliance, and to provide a reflection of heat impinging upon said sheet.

15. The appliance according to claim 14, wherein:

said viewing window comprises a first side and a second side opposite said first side;

said first, cylindrical, roller being mounted for rotation and positioned at said first side of said viewing window;

said actuating apparatus comprises:

a second roller;

said second roller being mounted for rotation and being positioned at said second side of said viewing window; and said actuating apparatus further comprises:

a pair of flexible elongated members;

said pair of flexible elongated members is connected at least to said second roller and said sheet, and is configured to effectuate at least unwinding of said sheet from said first, cylindrical, roller;

apparatus configured to rotate at least one of:

said first, cylindrical, roller and said second roller:

to unwind said sheet into said position to obscure viewing into the interior of the appliance; and to wind a portion of each of said pair of flexible elongated members onto said second roller;

said rotating apparatus being configured to rotate said first, cylindrical, roller:

to wind said sheet onto said first, cylindrical, roller from said position to obscure viewing through said window, into said position to permit viewing through said window; and to unwind a portion of each of said pair of flexible elongated members from said second roller.

16. The appliance according to claim 15, wherein said rotating apparatus comprises:

a device disposed to supply a torsional force to said first, cylindrical, roller;

said torsional device being configured to permit unwinding of said sheet from said first, cylindrical, roller into said position to obscure viewing through said window; and said torsional device being configured store a sufficient torsional force to rotate said first, cylindrical, roller to wind said sheet onto said first, cylindrical, roller into said position to permit viewing through said window.

17. The appliance according to claim 16, wherein said rotating apparatus comprises:

an electric-power drive-system disposed to rotate said second roller;

said electric-power drive-system being configured to provide a sufficient power to rotate said second roller to effectuate unwinding of said sheet from said first, cylindrical, roller from said position to permit viewing through said window, into said position to obscure viewing through said window;

said electric-power drive-system being configured to permit said torsional device of said first, cylindrical, roller to wind said sheet onto said first, cylindrical, roller from said position to obscure viewing through said window, into said position to permit viewing through said window; and said electric-power drive-system comprises switch apparatus to actuate said electric-power drive-system from the exterior of said viewing window.

18. The appliance according to claim 17, wherein:

said flexible elongated members comprise a material configured to withstand the heat generated by said appliance.

19. The appliance according to claim 18 comprising at least one of:

said sheet comprises a material configured to withstand the heat generated by said appliance;

said sheet comprises a material having a substantial resistance to tearing; and said sheet comprises TEFLON.

20. The appliance according to claim 17 comprising a microwave appliance, wherein said sheet comprises a material configured to provide shielding of the ambient surrounding said viewing window against microwave radiation.

* * * * *

UNITED STATES PATENT AND TRADEMARK OFFICE

CERTIFICATE OF CORRECTION

PATENT NO. : 6,467,475 B2
DATED : October 22, 2002
INVENTOR(S) : Kurt Leutner and Oliver Gros It is certified that error appears in the above-identified patent and that said Letters Patent is hereby corrected as shown below:

Column 6,
Line 66, after the second occurrence of "to", delete "obscute" and insert -- obscure --.

Signed and Sealed this

Eighteenth Day of March, 2003

JAMES E. ROGAN
*Director of the United States Patent and Trademark Office*